US007628639B2

(12) United States Patent
Matsumura et al.

(10) Patent No.: US 7,628,639 B2
(45) Date of Patent: Dec. 8, 2009

(54) LEVER TYPE CONNECTOR

(75) Inventors: Kaoru Matsumura, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/336,829

(22) Filed: Dec. 17, 2008

(65) Prior Publication Data

US 2009/0163062 A1 Jun. 25, 2009

(30) Foreign Application Priority Data

Dec. 20, 2007 (JP) ..... 2007-328959

(51) Int. Cl.
*H01R 13/62* (2006.01)

(52) U.S. Cl. ..... 439/372; 439/157

(58) Field of Classification Search ..... 439/157, 439/372

See application file for complete search history.

(56) References Cited

U.S. PATENT DOCUMENTS 5,344,194 A * 9/1994 Hatagishi et al. ..... 285/26
5,476,390 A * 12/1995 Taguchi et al. ..... 439/157
5,833,484 A * 11/1998 Post et al. ..... 439/352
6,312,273 B1 * 11/2001 Hasegawa et al. ..... 439/157
6,540,532 B1 * 4/2003 Martin et al. ..... 439/157
7,267,564 B2 * 9/2007 Bauman et al. ..... 439/157
7,445,475 B2 * 11/2008 Tajiri et al. ..... 439/157
2001/0046797 A1 * 11/2001 Sasaki et al. ..... 439/157
2001/0049215 A1 * 12/2001 Okabe et al. ..... 439/157
2006/0030186 A1 * 2/2006 Toyoda et al. ..... 439/157
2006/0281351 A1 * 12/2006 Yamaoka ..... 439/157
2006/0286834 A1 * 12/2006 Fukatsu et al. ..... 439/157
2007/0010113 A1 * 1/2007 Fukatsu et al. ..... 439/157
2007/0026709 A1 * 2/2007 Fukatsu ..... 439/157
2007/0293070 A1 * 12/2007 Takahashi ..... 439/157
2008/0096408 A1 * 4/2008 Tajiri et al. ..... 439/157
2009/0023317 A1 * 1/2009 Mizoguchi et al. ..... 439/157
2009/0163061 A1 * 6/2009 Matsumura et al. ..... 439/157
2009/0163062 A1 * 6/2009 Matsumura et al. ..... 439/157
2009/0163063 A1 * 6/2009 Matsumura et al. ..... 439/157
2009/0181566 A1 * 7/2009 Shibata ..... 439/157

FOREIGN PATENT DOCUMENTS

JP 2005-122942 A 5/2005

* cited by examiner

*Primary Examiner*—Ross N Gushi
(74) *Attorney, Agent, or Firm*—Sughrue Mion, PLLC

(57) ABSTRACT

Provided is a lever type connector for fitting connectors by swinging a lever 110, in which a lever side plate 102 is provided with a temporary locking arm 110. The temporary locking arm is provided with a bending restricting protrusion 113. When the temporary locking arm is deformed by applying excessive external force to a lever in a state where the lever before connector fitting is positioned at a temporary locking position, the bending restricting protrusion 113 restricts bending of the temporary locking arm in a temporary releasing direction (outward direction) by engaging with the inner face side of the lever side plate.

3 Claims, 14 Drawing Sheets

LEVER TYPE CONNECTOR

BACKGROUND OF THE INVENTION

1. Field of the Invention

The invention relates to a lever type connector capable of fitting or separating female and male connector housings with little force by a swing operation of a lever.

2. Description of the Related Art

A lever type connector is provided with a lever that is swingably mounted on one connector housing of a pair of connector housings fitted to each other, and help both connector housings to be fitted and separated by an operation of a cap mechanism provided between the lever and the other connector housing, by a swing operation of the lever.

For example, a lever of a lever type connector described in Patent Document 1 has a swing fulcrum portion (swing hole) fitted to a swing fulcrum portion (swing fulcrum protrusion) close to a connector housing on one end side of a pair of left and right lever side plates, and has a substantially U shape having an operation portion connecting both lever side plates to each other on the other side of the lever side plates. The lever has a cap protrusion (or cap groove) engaged with a cap groove (or cam protrusion) of the other connector housing, in the vicinity of the swing fulcrum portion.

In the lever type connector described above, in a step of fitting to an opponent connector in a state where the lever is previously and temporarily kept at a temporary locking portion, the cam groove and the cam protrusion can be engaged with each other even without particularly positioning the lever. For this reason, as an example described in Patent Document 1, a lever is provided with a temporary locking arm, and the temporary locking arm is engaged with a temporary locking protrusion on a connector housing side, thereby temporarily keeping the lever at the temporary locking position.

In this case, the temporary locking arm is provided as a protruding piece having a independent cantilever shape at an outer peripheral portion of the lever side plate, and thus it is possible to bend the temporary locking arm independently in a direction (particularly, outward direction) perpendicular to a lever side wall.

Patent Document 1: JP-A-2005-122942

However, a temporary locking arm is formed in an independent protruding shape. Accordingly, when excessive external force is applied to the temporary locking arm, the temporary locking arm may deviate from a temporary locking protrusion. That is, when strong external force is applied to a lever at the time of keeping or transporting a connector in a temporary locking state, the temporary locking arm is bent in a deviation direction (outward direction) of the temporary locking arm by the force applied to the temporary locking arm, and thus the temporary locking may deviate. When the temporary locking deviates, the position of the lever is not determined and it is difficult to easily fit the lever with a target connector.

SUMMARY OF THE INVENTION

The invention has been made to solve the aforementioned problem, and is to provide a lever type connector with high reliability by preventing an unnecessary deviation accident in the temporary locking of the lever.

According to a first aspect of the invention, there is provided a lever type connector in which a lever is swingably mounted on one connector housing of a pair of connector housings fitted to each other, the lever has a substantially U shape having a pair of lever side plates having a swing fulcrum portion on each end side, and an operation portion connecting the other ends of the pair of lever side plates to each other, the lever is mounted on one connector housing by fitting the swing fulcrum portion close to the lever to the swing fulcrum portion provided on an outer peripheral face of the one connector housing, and the lever is swung in a connector fitting direction from a temporary locking position kept by engaging a flexible temporary locking arm protruding on the lever side plate with a temporary locking protrusion formed on the one connector housing, thereby fitting both of the connectors housings to each other by an operation of a cam mechanism provided between the lever and the other connector housing, wherein the temporary locking arm is provided with a bending restricting unit, and when predetermined external force is applied to the lever in a state where the lever is positioned at the temporary locking position before connector fitting, the bending restricting unit engages with the lever side plate by deformation of the temporary locking arm caused by the external force to restrict bending of the temporary.

According to a second aspect of the invention, in the lever type connector according to the first aspect, the temporary locking arm is disposed in a cantilever shape close to an outer peripheral portion on the front side of the lever side plate in the connector fitting direction, with a spilt gap between the lever side plate and the temporary locking arm, and the locking to the temporary locking protrusion is released by bending the temporary locking arm outward, and wherein a protrusion is provided as the bending restricting unit, and when the temporary locking arm is deformed in a direction of making the spilt gap narrow by applying the predetermined external force, the protrusion is engaged with the inside of the adjacent lever side wall, thereby restricting bending of the temporary locking arm outward.

According to a third aspect of the invention, in the lever type connector according to the second aspect, a clearance groove for avoiding interference of the lever side plate and the temporary locking protrusion at the time of swinging the lever is formed in the inner face of the lever side plate, and the bending restricting protrusion of the temporary locking arm is configured to go into the clearance groove.

According to the first aspect of the invention, even when the temporary locking arm is deformed by applying excessive external force to the lever in the state where the lever before connector fitting is at the temporary locking position, the bending restrict unit provided on the temporary locking arm restricts bending of the temporary locking arm in the temporary locking direction. Accordingly, the engagement state of the temporary locking arm and the temporary locking protrusion is kept, and thus the temporary locking arm does not easily deviate. Therefore, it is possible to keep the temporary locking state of the lever, and thus it is possible to improve reliability.

According to the second aspect of the invention, when the temporary locking arm is deformed, the outward bending of the temporary locking arm is restricted by engaging the protrusion provided on the temporary locking arm with the inner face side of the adjacent lever side plate. Therefore, it is possible to improve reliability just by providing the temporary locking with the protrusion.

According to the third aspect of the invention, as a void to which the protrusion goes at the time of deforming the temporary locking arm, the clearance grove provided on the inner face of the lever side plate to avoid the temporary locking protrusion is used. Therefore, it is unnecessary to secure a new void separately, and it is possible to improve reliability just by adding the protrusion.

DESCRIPTION OF THE PREFERRED EMBODIMENTS

Hereinafter, an embodiment of the invention will be described with reference to the drawings.

Figure 1:
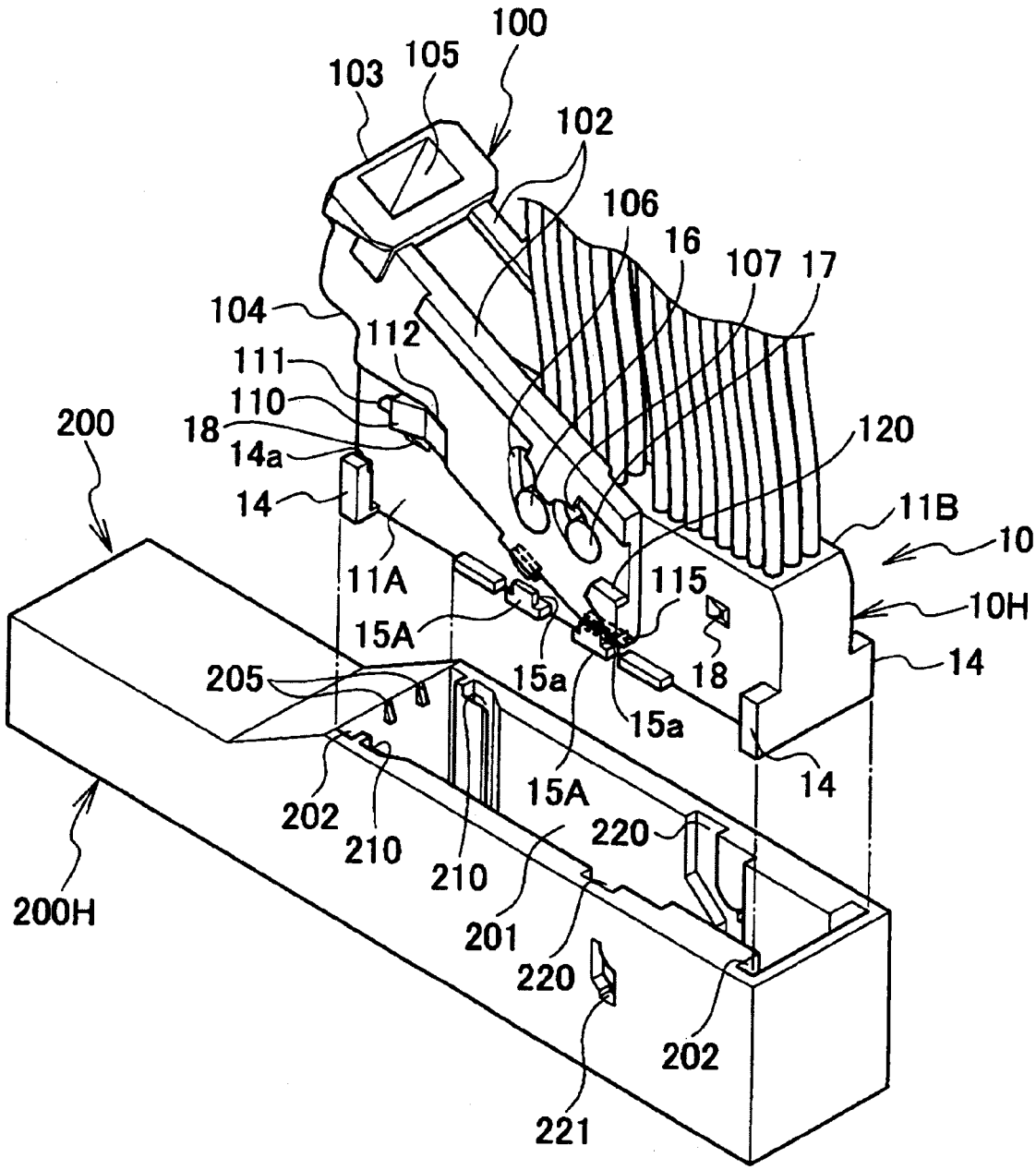
FIG. 1 is a perspective view illustrating a state before fitting of a lever type connector according to an embodiment.
Figure 2:
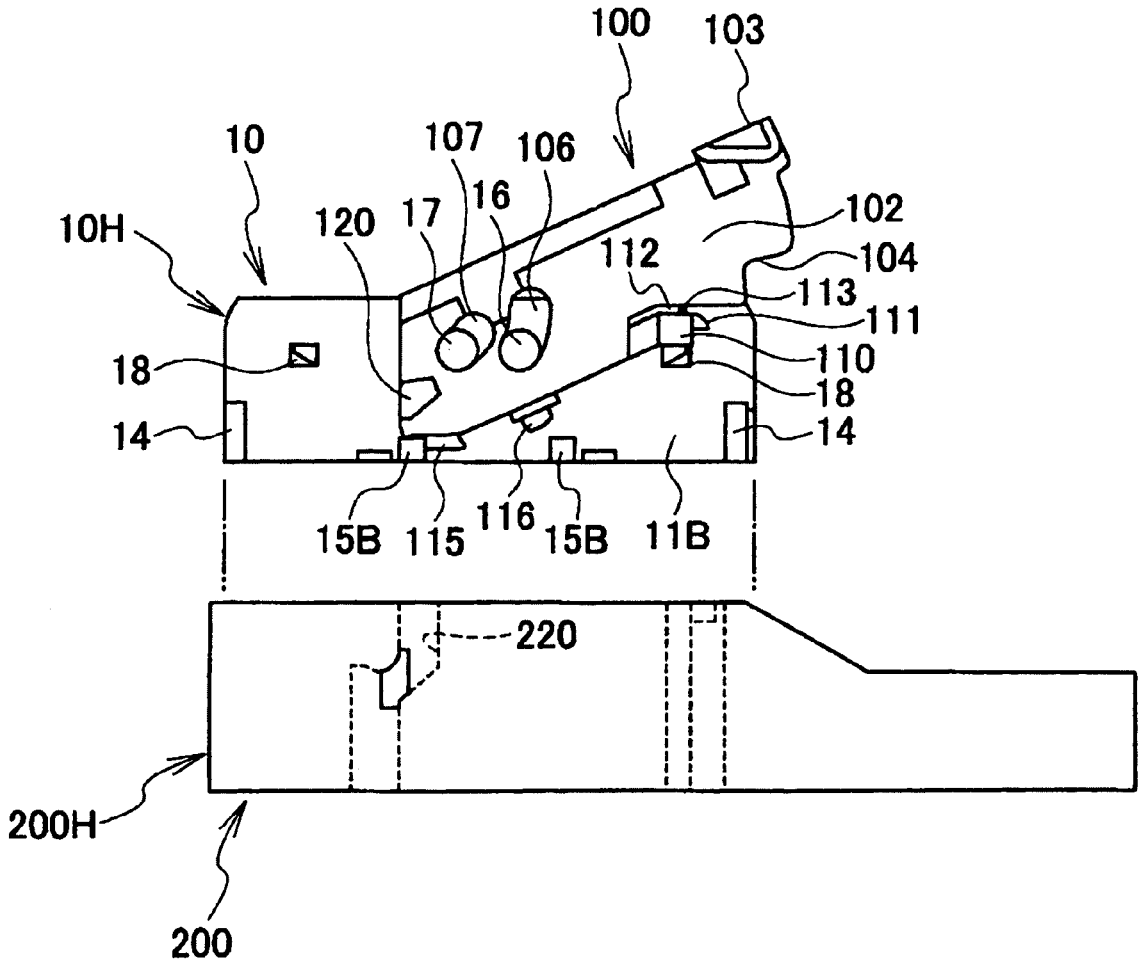
FIG. 2 is a side view as viewed from the side opposite to FIG. 1.
Figure 3:
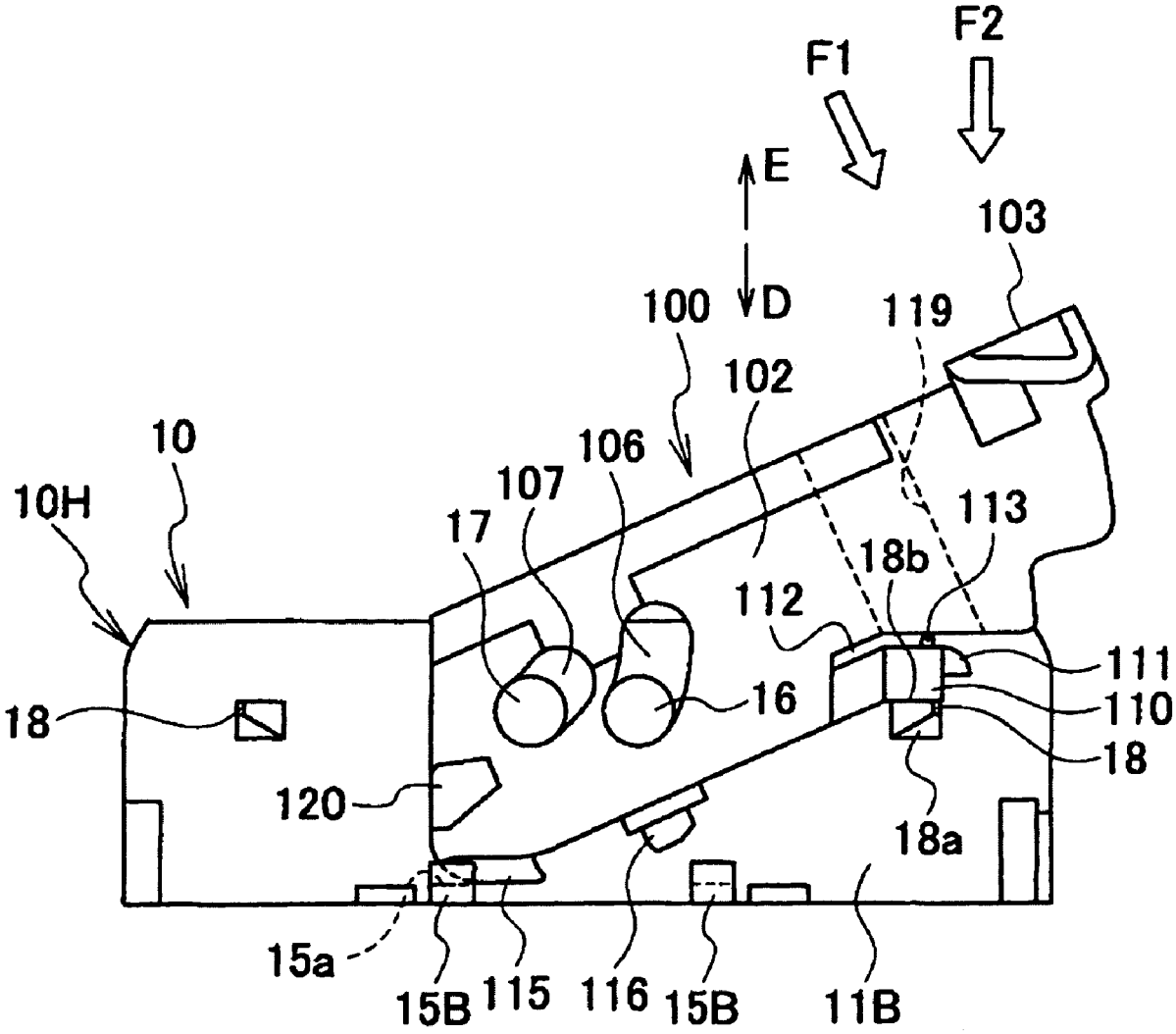
FIG. 3 is a side view illustrating a state where a lever is mounted on a male connector and is kept at a temporary locking position.
Figure 4:
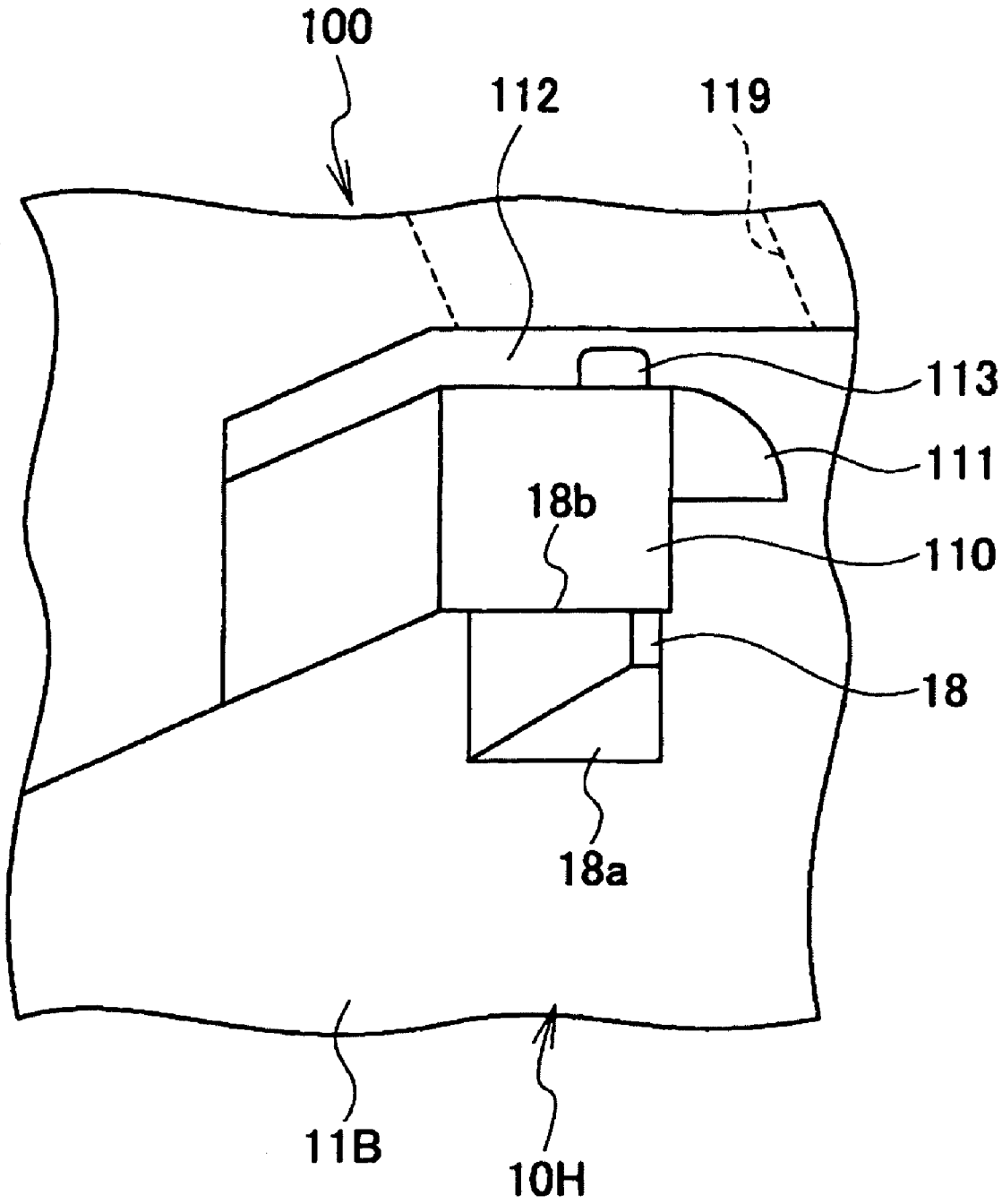
FIG. 4 is an enlarged view illustrating a main part.
Figure 5:
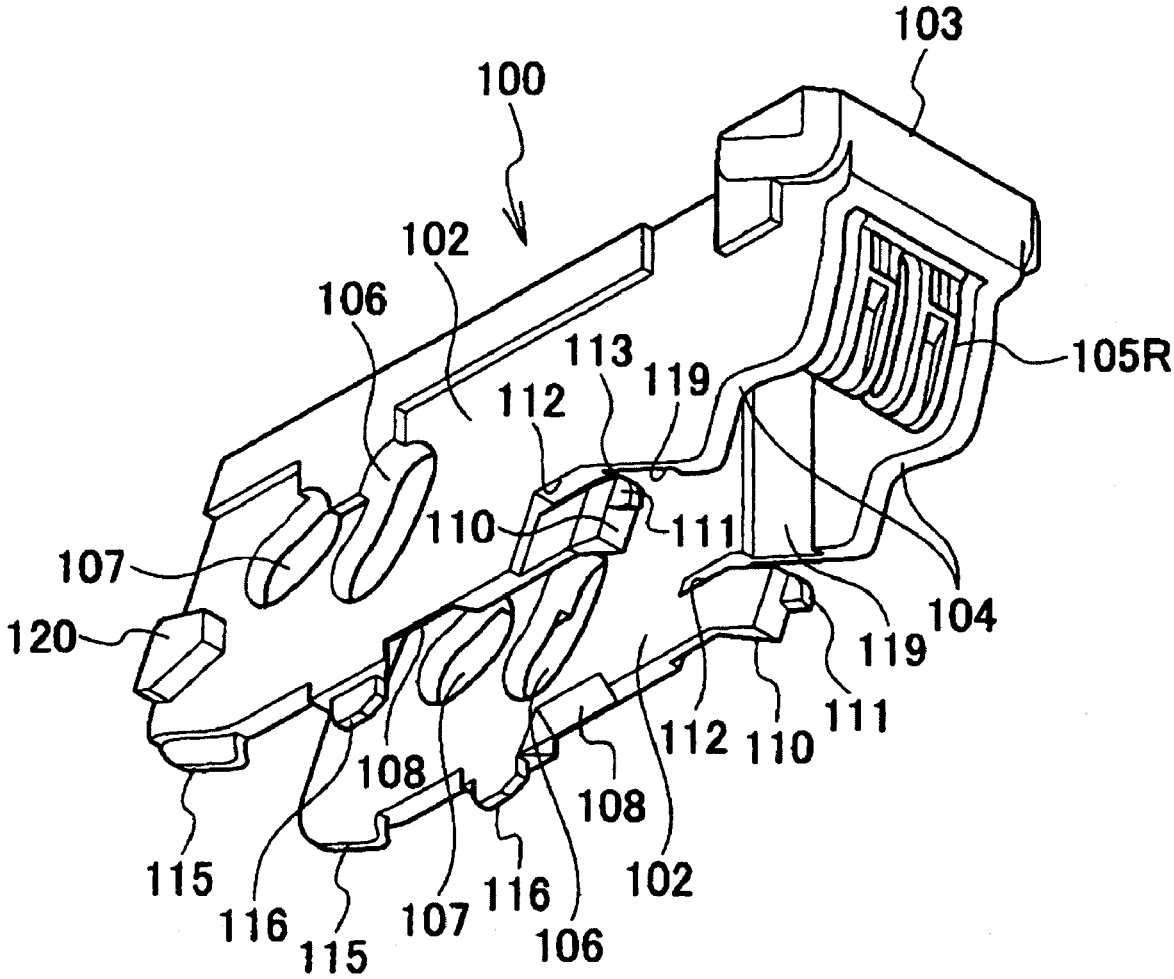
FIG. 5 is a perspective view as viewed from the bottom of a lever.
Figure 6:
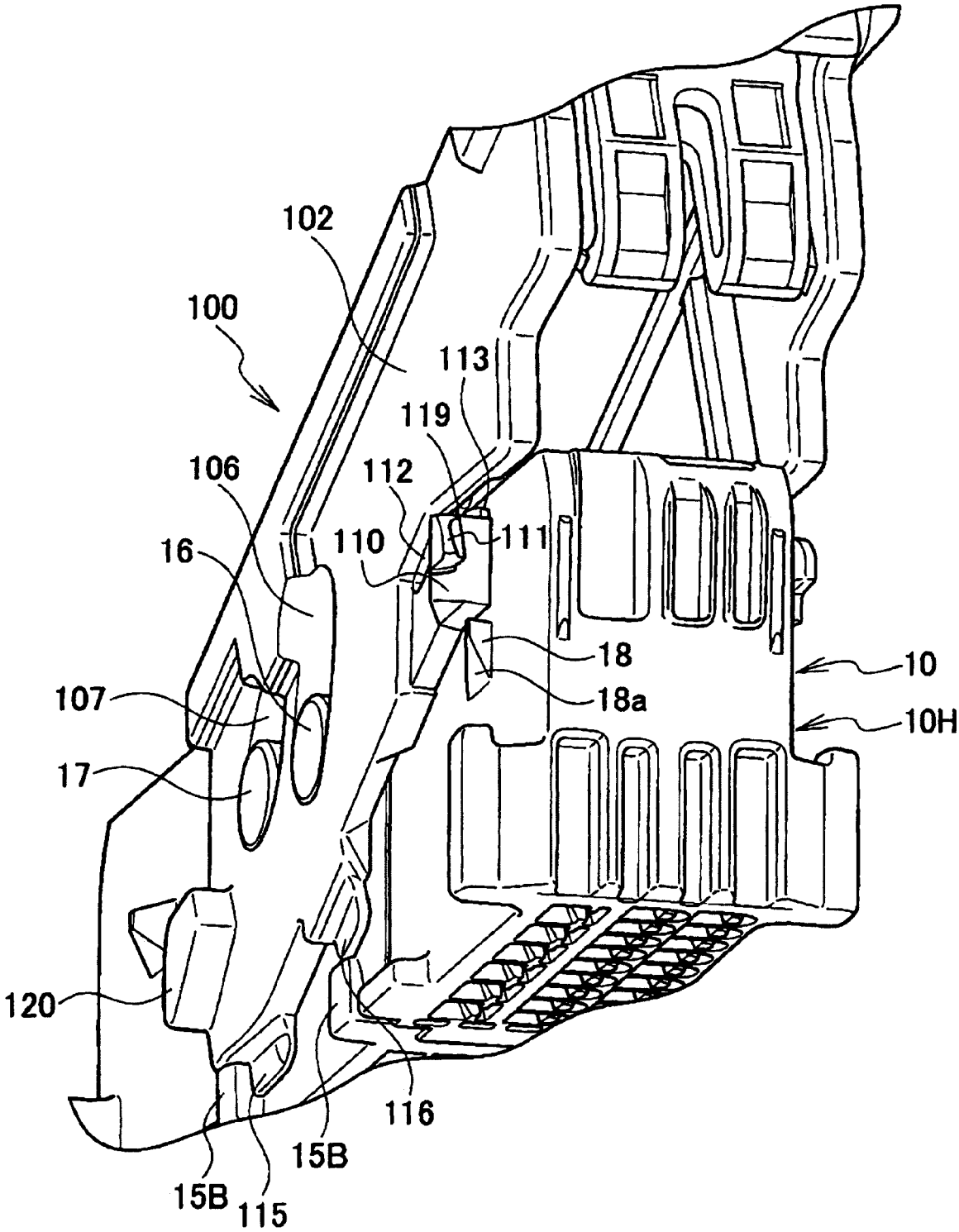
FIG. 6 is a perspective view illustrating a temporary locking arm as viewed from the bottom.
Figure 7:
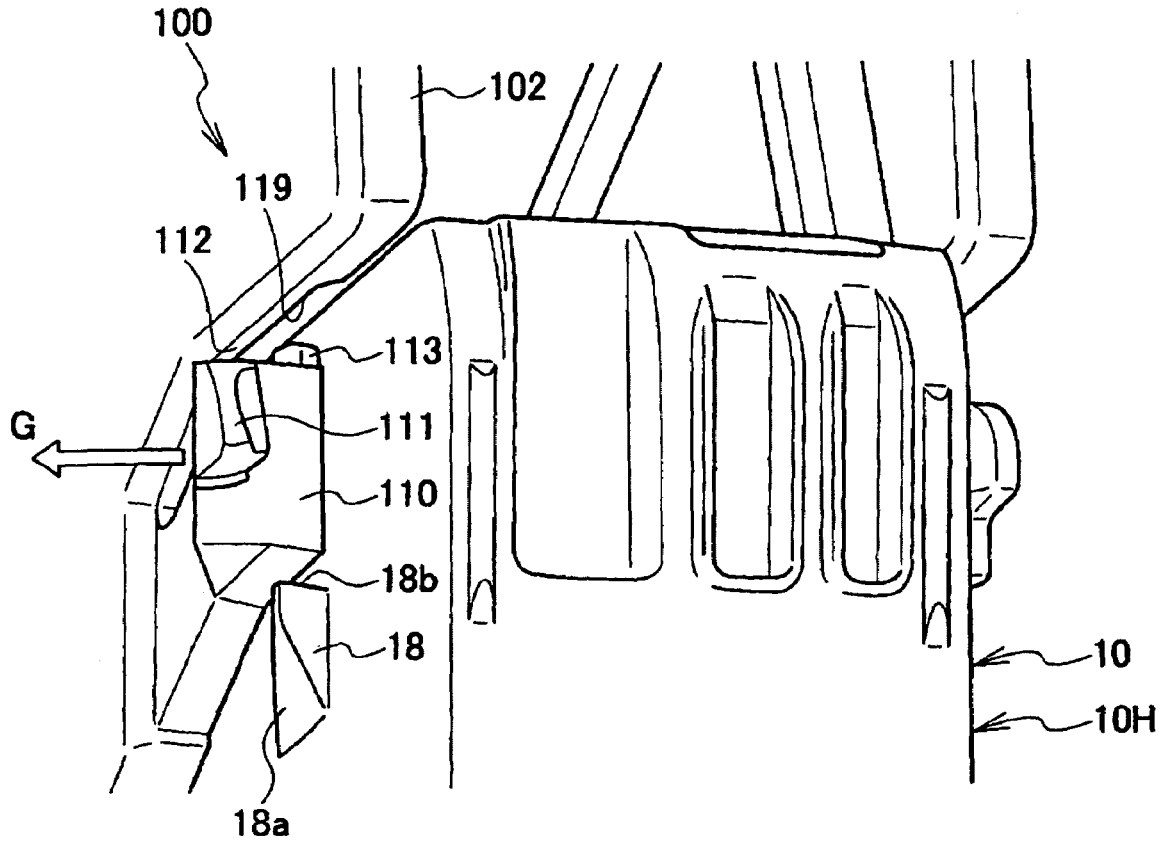
FIG. 7 is an enlarged perspective view illustrating relationship between a clearance groove and a protrusion provided on a temporary locking arm.
Figure 8:
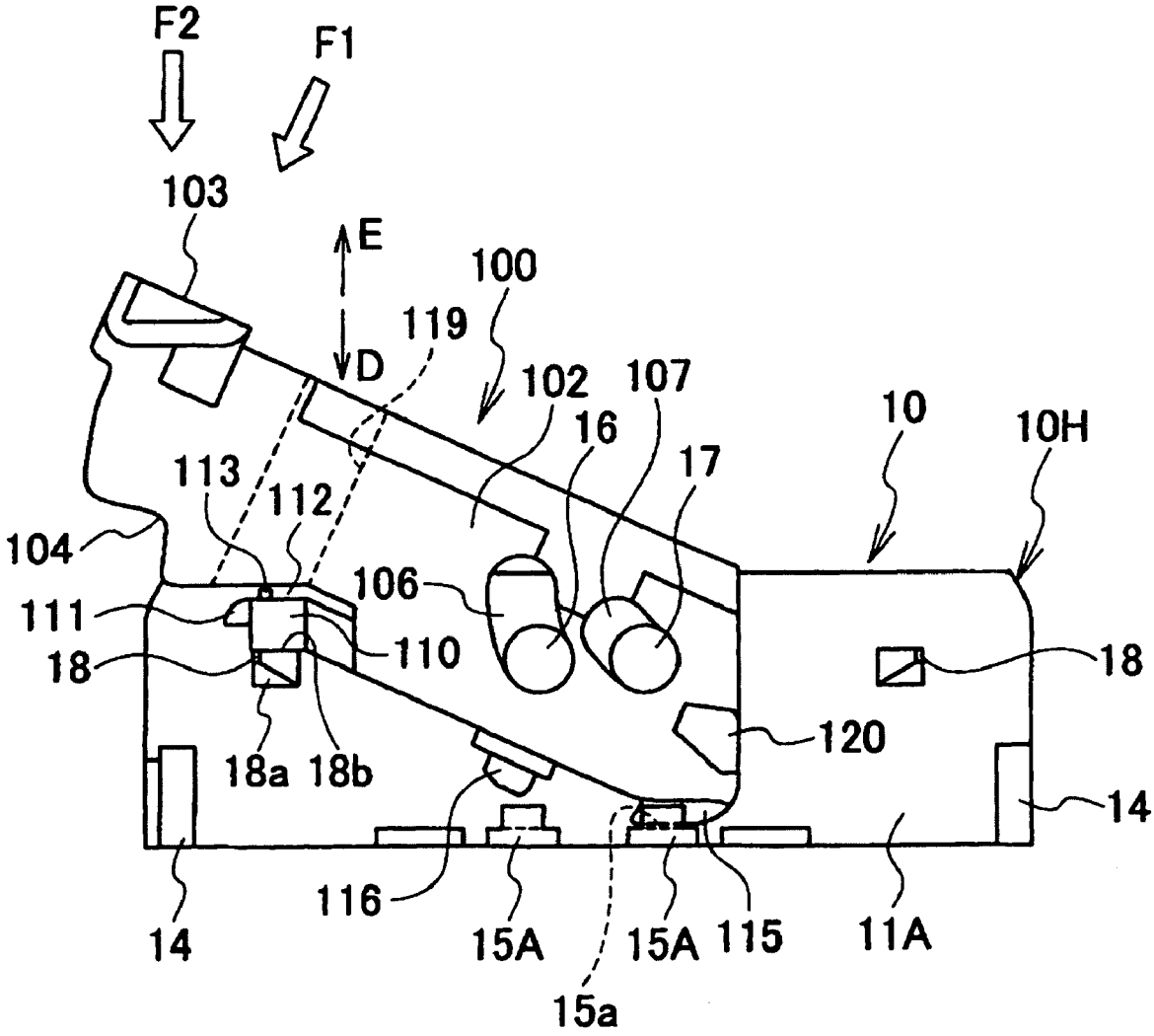
FIG. 8 is a side view illustrating the state shown in FIG. 3 as viewed from the opposite side.
Figure 9:
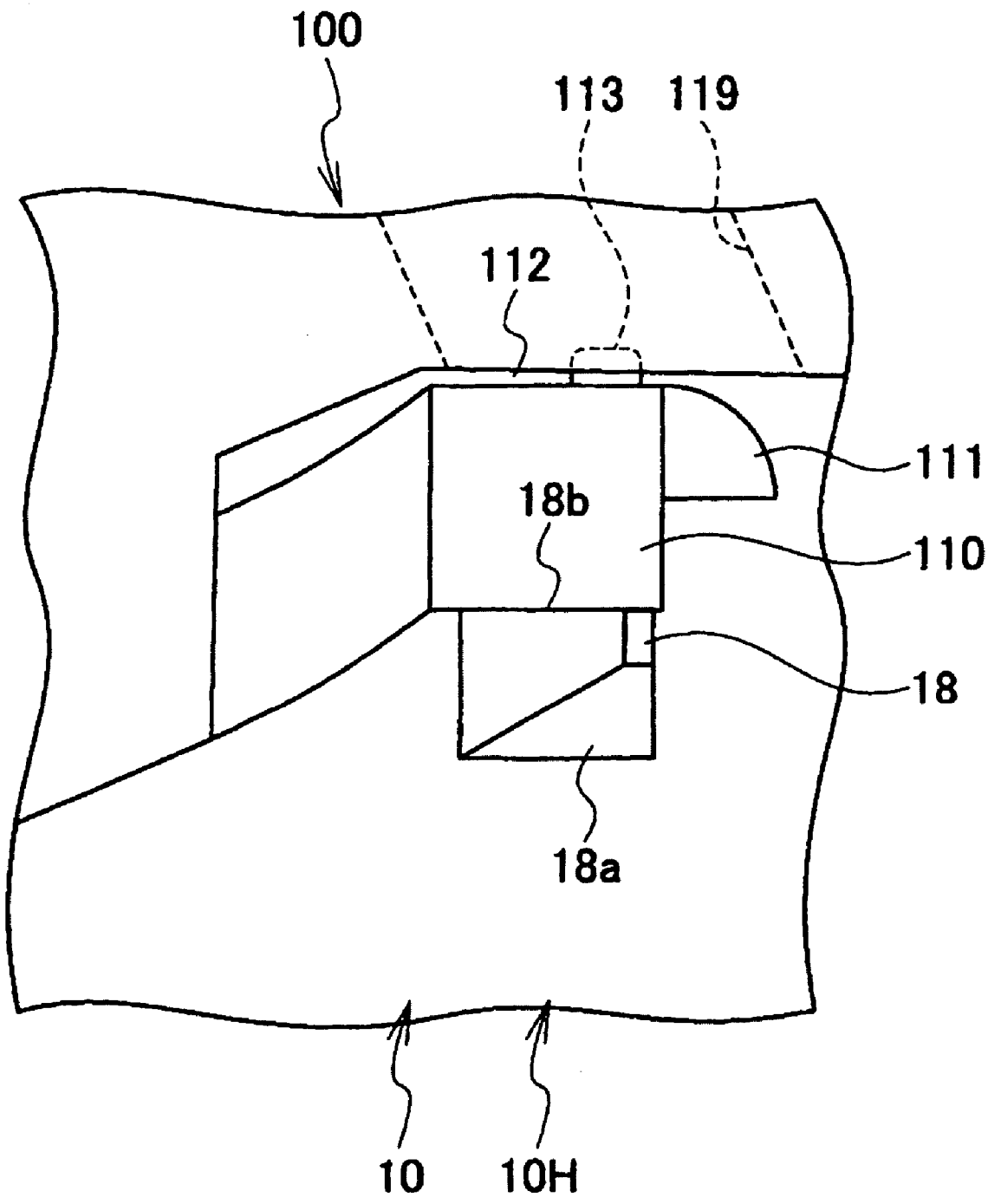
FIG. 9 is an enlarged side view illustrating a state where external force is applied to the lever to deform the temporary locking arm from the state shown in FIG. 4, and the protrusion goes into the inner face of the lever side plate.
Figure 10:
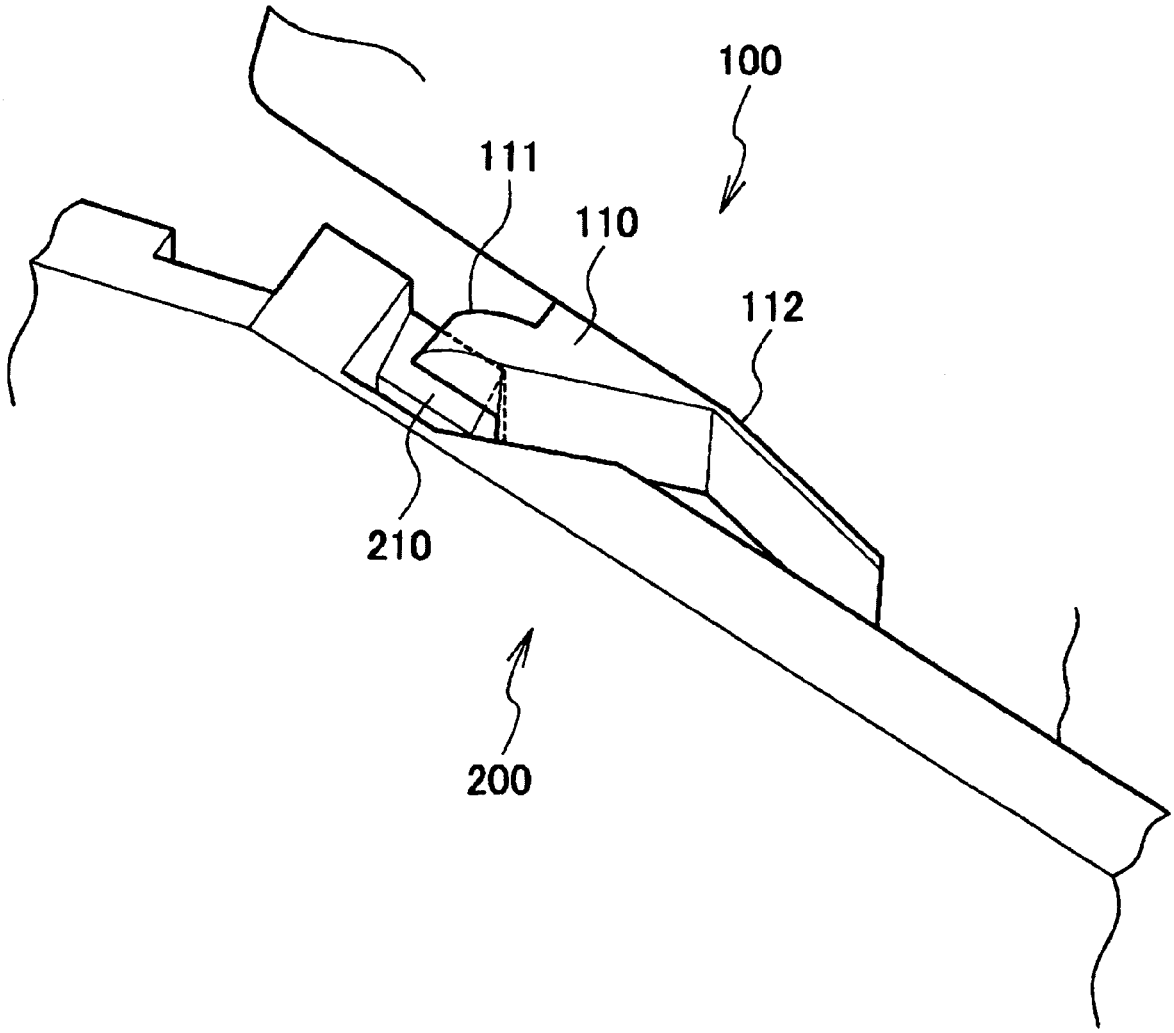
FIG. 10 is a perspective view a relationship between a temporary locking arm close to the lever and a temporary releasing portion close to an arm connector as diagonally viewed from the top, in an initial step of fitting a male connector to a female connector in the state where the lever is set to the temporary locking position.
Figure 11:
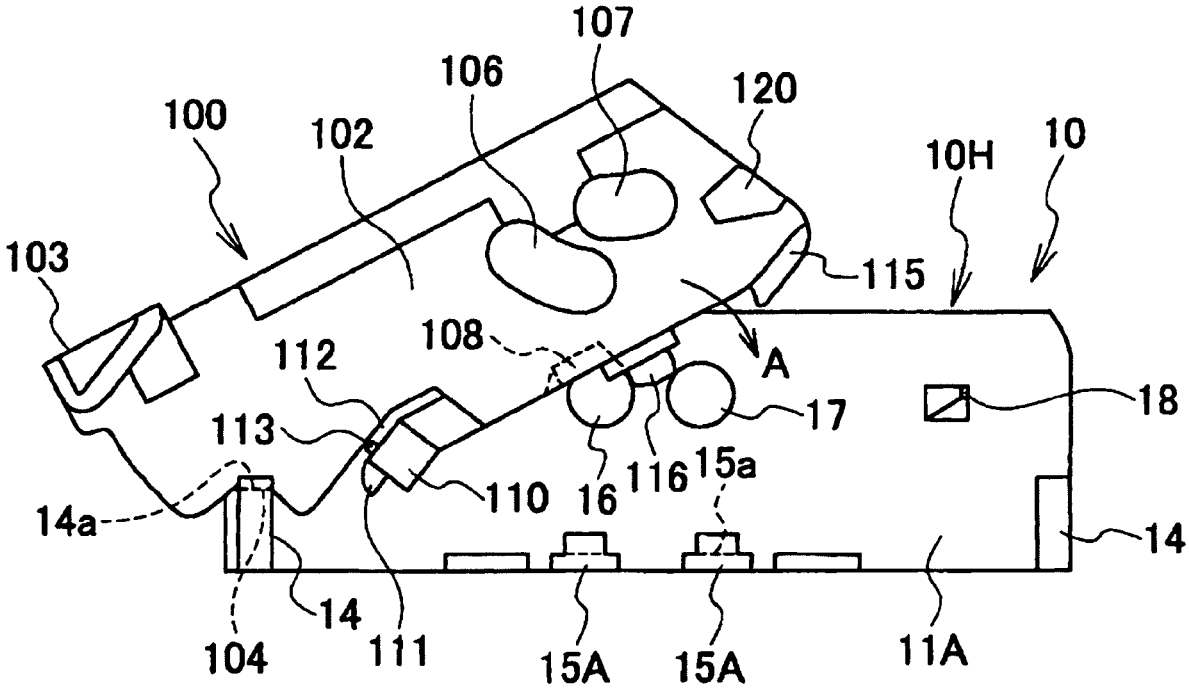
FIG. 11 is a side view illustrating a state where a lever is slightly swung from the first step of mounting the lever on the male connector housing.
Figure 12:
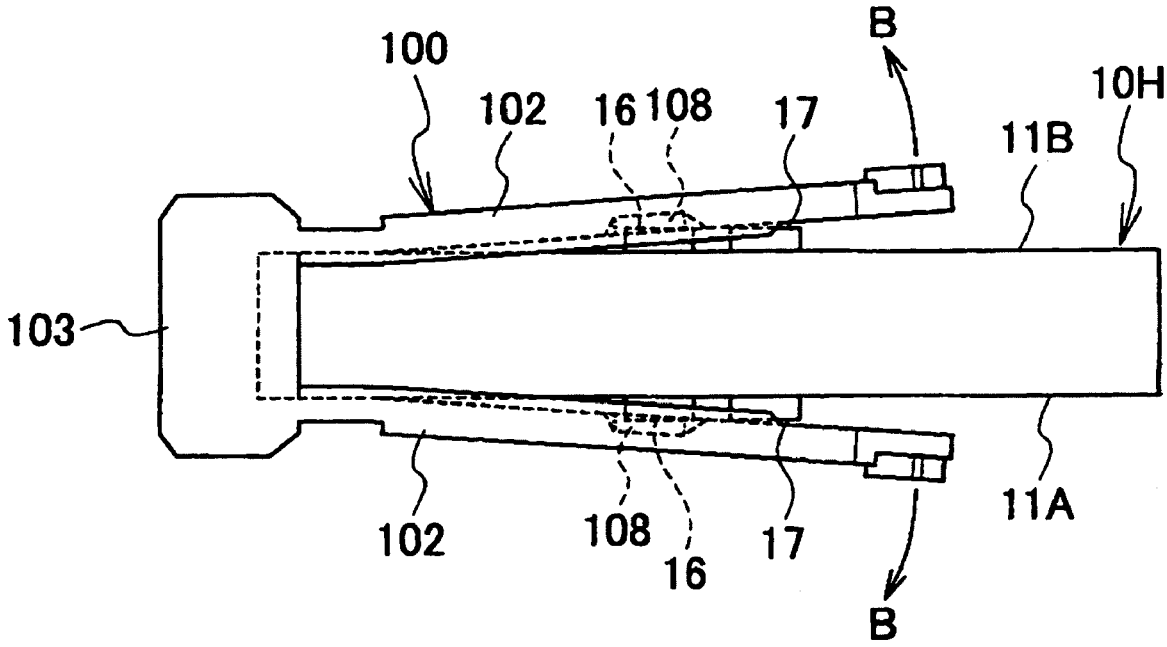
FIG. 12 is a schematic plan view illustrating the state shown in FIG. 11 as viewed from the top.
Figure 13:
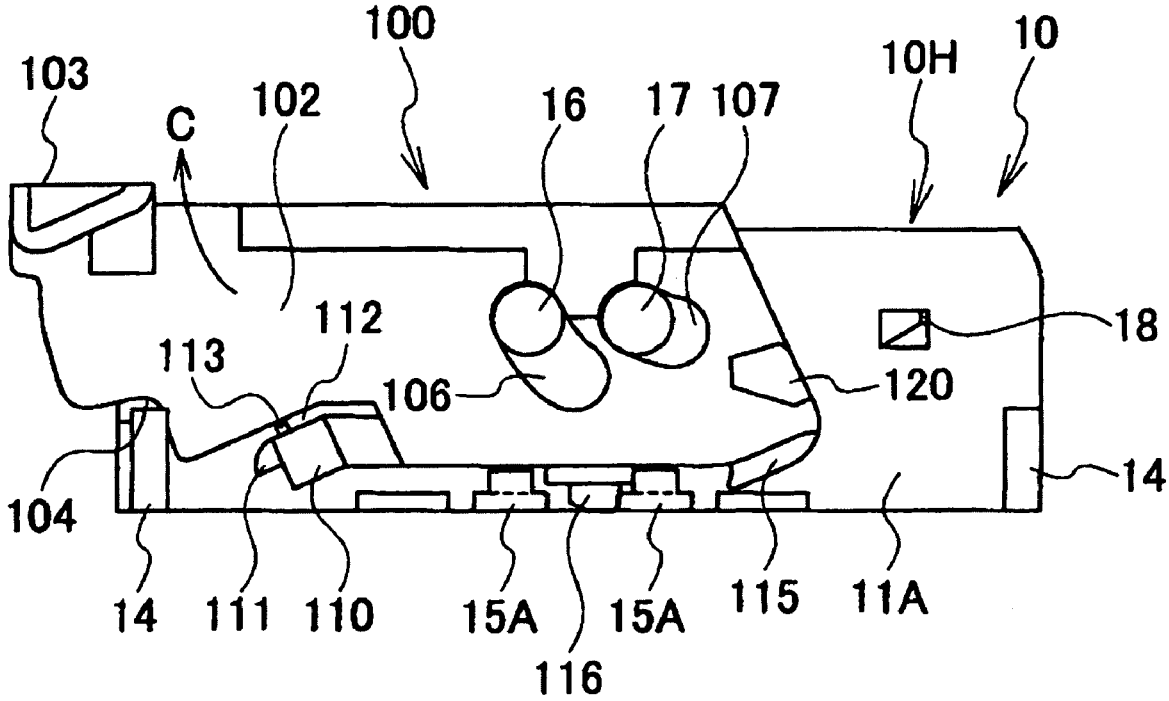
FIG. 13 is a side view illustrating a state before swinging the lever to a temporary locking position in the state of mounting the lever on the male connector.
Figure 14:
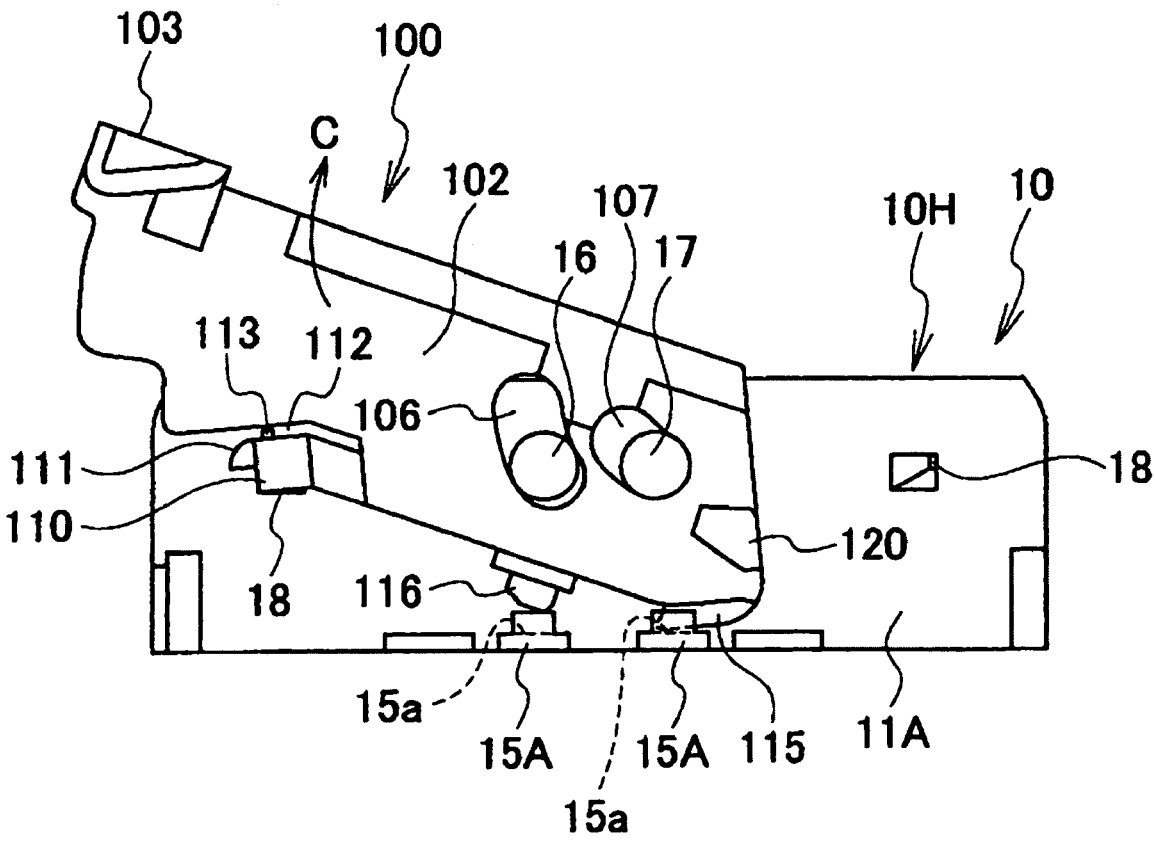
FIG. 14 is a side view illustrating a step in the course of swing the lever to a temporary locking position from the state shown in FIG. 13.

FIG. 1 is a perspective view illustrating a state before fitting of a lever type connector according to an embodiment. FIG. 2 is a side view as viewed from the side opposite to FIG. 1. FIG. 3 is a side view illustrating a state where a lever is mounted on a male connector and is kept at a temporary locking position. FIG. 4 is an enlarged view illustrating a main part. FIG. 5 is a perspective view as viewed from the bottom of a lever. FIG. 6 is a perspective view illustrating a temporary locking arm as viewed from the bottom. FIG. 7 is an enlarged perspective view illustrating relationship between a clearance groove and a protrusion provided on a temporary locking arm. FIG. 8 is a side view illustrating the state shown in FIG. 3 as viewed from the opposite side. FIG. 9 is an enlarged side view illustrating a state where external force is applied to the lever to deform the temporary locking arm from the state shown in FIG. 4, and the protrusion goes into the inner face of the lever side plate. FIG. 10 is a perspective view a relationship between a temporary locking arm close to the lever and a temporary releasing portion close to an arm connector as diagonally viewed from the top, in an initial step of fitting a male connector to a female connector in the state where the lever is set to the temporary locking position. FIG. 11 is a side view illustrating a state where a lever is slightly swung from the first step of mounting the lever on the male connector housing. FIG. 12 is a schematic plan view illustrating the state shown in FIG. 11 as viewed from the top. FIG. 13 is a side view illustrating a state before swinging the lever to a temporary locking position in the state of mounting the lever on the male connector. FIG. 14 is a side view illustrating a step in the course of swing the lever to a temporary locking position from the state shown in FIG. 13.

As shown in FIG. 1 and FIG. 2, the lever type connector includes a male connector 10 having a male connector housing 10H provided with a plurality of terminals (now shown), a female connector 200 having a female connector housing 200H provided with a plurality of terminals (not shown), a lever 100 helping the male connector 10 and the female connector 200 to be fitted and separated by a swing operation.

The lever 100 is swingably provided on the male connector housing 10H of the male connector housing 10H and the female connector housing 200H fitted to each other.

The female connector housing 200H has a fitting hole 201 for fitting the male connector housing 10H, and the lever 100 provided on the male connector housing 10H is configured to be inserted to the fitting hole 201 of the female connector housing 200H together with the male connector housing 10H.

As shown in FIG. 1 to FIG. 3 and FIG. 5, the lever 100 has a substantially U shape having a pair of lever side plates 102 and 102 having swing holes (swing fulcrum portion) 106 and 107 on each one end side, an operation portion 103 connecting the other ends of the pair of lever side plates 102 and 102 to each other. One end side of the pair of the lever side plates 102 and 102 is opened outward, thereby swingably fitting the swing holes 106 and 107 to swing fulcrum protrusions (swing fulcrum portion) 16 and 17 provided on the outside faces 11A and 11B of the male connector housing 10H.

The operation portion 103 of the lever 100 is provided with an opening 105 having a lock arm 105R, and the lock arm 105R is locked to a lock portion 205 (see FIG. 1) provided on an inner wall of the fitting hole 201 of the female connector housing 200H when the male connector 10 is completely fitted to the female connector 200 by swinging the lever 100, thereby keeping a fitting state.

The lever type connector helps both of the connector housings 10H and 200H to be fitted and separated by an operation of a cam mechanism provided between the lever 100 and the female connector housing 200H, by swinging the lever 100. A cam groove 220 constituting the cam mechanism and a cam protrusion 120 engaged with the cam groove 220 are formed on the inside face of the fitting hole 201 of the female connector housing 200H and the outside face of the lever side plate 102, respectively.

Each of the male connector housing 10H, the lever 100, and the female connector housing 200H is formed of one-formed article of resin. A drawing-out hole 221 for drawing out at the time of forming the cam groove 220 is provided on the sidewall of the fitting hole 201 of the female connector housing 200H. A guide groove 202 parallel to a connector fitting direction is formed at the left and right ends of the insides of the opposite side walls of the fitting hole 201.

On the front end side of the outer peripheral portion of the operation portion 3 side of each lever side plate 102, "^"-shaped notch portion 104 is formed. A rib 14 for guide inserted to a guide groove 202 formed in the female connector housing 200H in a sliding manner protrudes on both end faces of left and right direction of the outside faces 11A and 11B of the male connector housing 10H. The ribs 14 are fulcrums of the swing operation at the time of mounting the lever 100 on the male connector housing 10H by engaging the notch portions 104 of the lever side plate 102 with the rib 14 on one end side. A shallow groove 14*a* for easily engaging the notch portion 104 of the lever 100 is formed at the upper end of the rib 14.

As shown in and FIG. 4, guide slopes 108 are formed on the inner faces of the peripheral portion of both of the lever side plates 102 in the connector fitting direction. When the swing holes 106 and 107 provided on the lever side plates 102 are fitted to the swing fulcrum protrusions 16 and 17 provided on the outside faces 11A and 11B of the male connector housing 10H by swinging the lever 100 about the rib 14 as a fulcrum on the male connector housing 10H side, the guide slope 108 guides the lever side plates 102 to be mounted on the swing fulcrum protrusions 16 and 17 to promote the lever side plates 102 to be opened outward, thereby guiding the fitting of the swing holes 106 and 107 to the swing fulcrum protrusions 16 and 17.

In the embodiment, two swing fulcrum protrusions 16 and 17 and two swing holes 106 and 107 are provided in a direction substantially perpendicular to the connector fitting direction, so that a direction of attaching the lever 100 to the male connector housing 10H can be selected in two ways. The guide slope 108 is provided only at a position corresponding to the swing fulcrum protrusion 16 and the swing hole 106 close to the operation portion 31 of the lever side plate 102.

The lever 100 fits the swing holes 106 and 107 to the swing fulcrum protrusion 16 and 17 by swinging the lever 100 about the rib 14 as a fulcrum in a state of engaging the notch portion 104 with the rib 14. Then, the lever 100 is configured to be set at a temporary locking position before connector fitting by swinging the lever 100 in a direction opposite to the mounting of the lever 100 about the fitting portions as a fulcrum of the swing holes 106 and 107 and the swing fulcrum protrusions 16 and 17.

FIG. 1 to FIG. 3 shows a state where the lever 100 is kept at a temporary locking position. To temporarily keep the lever 100 at the temporary locking position, a flexible temporary locking arm protrudes on the lever side plate 102. A temporary locking protrusion 18 engaged with the temporary locking arm 110 is provided on the outside faces 11A and 11B of the male connector housing 10H.

The temporary locking arm 110 temporarily keeps the lever 100 at the temporary locking position by engaging with the temporary locking protrusion 18, and disposed in a cantilever shape close to the outer peripheral portion on the front side of the lever side plate 102 in the connector fitting direction, with a spilt gap 112 between the lever side plate 102 and the temporary locking arm 110. In a normal state, the temporary locking arm 110 is positioned at a stationary position capable of engaging with the temporary locking protrusion 18. The temporary locking arm 110 is configured to release the engagement with the temporary locking protrusion 18 by bending the lever side plate 102 outward.

A small protrusion 113 is provided as means for restricting bending of the temporary locking arm 110 for any case on the side face close to the spilt gap 112 of the temporary locking arm 110. As shown in FIG. 3 and FIG. 8, in a state where the lever 100 is positioned at the temporary locking position before connector fitting, when excessive external force F1 or F2 is applied to the lever 100 to deform the temporary locking arm 110, the protrusion 113 engages with the inner side of the lever side plate 102, thereby restricting bending of the temporary locking arm 100 in a temporary releasing direction (outward direction).

That is, as shown in FIG. 9, when the excessive external force F1 or F2 is applied to the temporary locking arm 110 to deform the temporary locking arm 110 in a direction of making the spilt gap 112 narrow, the protrusion 113 engages with the inner face side of the adjacent lever side wall 102, thereby restricting bending of the temporary locking arm 110 outward (direction indicated by the arrow G shown in FIG. 7).

In this case, as shown in FIG. 5, FIG. 6, and FIG. 7, a clearance groove 119 for avoiding interference of the protrusion 18 and the lever side plate 102 at the time of swinging the lever 100 is formed on the inner face side of the lever side plate 102. The protrusion 113 enters the clearance groove 119 serving as a void, and thus the protrusion 113 is engaged with the inner face of the lever side plate 102.

An inclined face 18*a* for allowing the temporary locking arm 110 to be mounted on the temporary locking protrusion 18 while bending the temporary locking arm 110 outward by sliding with the temporary locking arm 110 is provided on the side face of the front end side of the temporary locking protrusion 18 in the connector fitting direction. An engagement wall 18*b* engaging with the end face of the temporary locking arm 110 is provided on the side face opposite to the inclined face 18*a*.

A temporary releasing protrusion 111 is provided at the front end of the temporary locking arm 110. As shown in FIG. 10, a temporary releasing portion 210 is provided on the inner wall of the fitting hole 201 of the female connector housing 200H. In the initial step of fitting the female connector 200 to the male connector 10, the temporary releasing portion 210 releases the temporary locking to the temporary locking protrusion 18 by bending the temporary locking arm 110, by the interference with the temporary locking protrusion 111.

Protrusions 115 and 116 are provided at the outer peripheral portion on the front side in the connector fitting direction on the side (one end side) opposite to the operation portion 103 of the lever side plate 102. Ring-shaped reception portions 15A and 15A for preventing the lever side plate 102 outward by engaging with the protrusions 115 and 116 provided at the outer peripheral portion of the lever side plate 102 are provided at the front ends of the outside faces 11A and 11B of the male connector housing 10H for mounting the lever 100 in the connector fitting direction. A groove 15*a* through which the protrusions 115 and 116 pass is formed on the inner side of the reception portion 15A.

The protrusions 115 and 116 and the reception portions 15A and 15B are provided in a positional relation of a plurality of engagement in a normal state in the course of swinging the lever 100 to the temporary locking position after mounting the lever 100 on the male connector housing 10H, and when the lever 100 mounted on the male connector housing 10H is set at the temporary locking position before connector fitting.

In the embodiment, a direction of attaching the lever 100 to the male connector housing 10H can be selected in two ways of a first direction and a second direction opposite to the first direction, and the male connector housing 10H is configured in bilateral symmetry. Accordingly, corresponding thereto, the reception portions 15A and 15B are provided also in bilateral symmetry about the central position in the left and right directions of the male connector housing 10H. As can be seen by comparing FIG. 8 and FIG. 9 with each other, a space between two reception portions 15A of the outside face 11A on the front face is different from a space between two reception portions 15A of the outside face 11B on the back side.

Next, an operation will be described.

To assemble the lever 100 with the male connector housing 10H, as shown in FIG. 11, first, "^"-shaped notch portion 104 provided on the lever side plate 102 is hooked to the rib 14 provided at the end portion of the male connector housing 10H. Then, the lever 100 is swung in a direction indicated by the arrow A about the rib 14 as a fulcrum.

Then, the outer peripheral portion of the lever side plate 102 of the lever 100 comes into contact with the swing fulcrum protrusions 16 and 17. At that time, as shown in FIG. 11 and FIG. 12, the swing fulcrum protrusion 16 close to the operation portion 103 comes into contact with the guide slope 108 provided on the inner face of the outer peripheral portion of the lever side plate 102. Accordingly, the lever side plate 102 is opened in a direction indicated by the arrow B shown in FIG. 12 by the operation of the guide slope 108 according to the swinging (putting in) of the lever 100, thereby fitting the swing fulcrum protrusions 16 and 17 to the swing holes 106 and 107.

At this time, the fulcrum of the swing operation is clearly determined by engaging the notch portion 104 with the rib 14. Accordingly, the guide slope 108 is automatically positioned at the swing fulcrum protrusion 16 without particular eye measurement. Therefore, it is possible to mount (fitting of the swing fulcrum protrusions 16 and 17 and the swing holes 106 and 107) the lever 100 only by further swinging the lever 100.

Accordingly, it is unnecessary to perform the positioning while excessively widening the lever side plate 102 using an exclusive jig. Therefore, it is possible to simply fit the swing holes 106 and 107 of the lever side plate 102 to the swing fulcrum protrusions 16 and 17 of the male connector housing 10H with minimum load. As a result, it is possible to improve workability of assembly, and thus it is possible to assemble the lever 100 with the male connector housing 10H with one touch in the air.

In the embodiment, two swing fulcrum protrusions 16 and 17 are provided transversely. However, since the guide slope 108 comes into contact with the swing fulcrum protrusion 16 (on a base end side) close to the operation portion 103 of the lever side plate 102, it is possible to open the lever side plate more widely than the lever side plate 102 with respect to the swing fulcrum protrusion 17 positioned more away from the operation portion 103 of the lever 100 by mounting the lever side plate 102 on the swing fulcrum protrusion 16 by the operation of the guide slope 108. Accordingly, about the swing fulcrum protrusion 17 positioned away from the operation portion 103, it is possible to easily fit the swing hole 107 without a guide slope, and the minimum number of guide slopes 108 may be provided.

As described above, when the lever 100 is assembled with the male connector housing 10H, the lever 100 is in a state shown in FIG. 13. At this time, the lever 100 is moved in a direction indicated by the arrow C. That is, a part of the lever 100 close to the operation portion 103 is pulled up about the fitting part of the swing fulcrum protrusions 16 and 17 and the swing holes 106 and 107 as a fulcrum. Then, as shown in FIG. 14, the temporary locking arm 110 is mounted on the inclined face 18*a* of the temporary locking protrusion 18. As shown in FIGS. 3 and 8, a bent position returns to a normal position, thereby engaging the temporary locking arm 110 with the locking wall 18*b* of the temporary locking portion 18.

This state is the temporary locking state shown in FIG. 1 and FIG. 2. When the lever 100 is positioned at the temporary locking position, the lever 100 is temporarily locked not to move in a direction indicated by the arrow D or the arrow E shown in FIG. 3. That is, the temporary locking arm 110 is locked by engaging with the temporary locking protrusion 18 in the direction indicated by the arrow D, and the other interference part serves as a stopper, thereby locking the lever 100. The lever 100 is kept in this state with respect to the male connector, before fitting to the female connector 200.

In the temporary locking state of the lever 100 embodied as described above, the protrusion 115 close to the lever 100 and the reception portions 15A and 15B close to the connector housing 10H engage with each other. Accordingly, it is possible to prevent the lever side plate 102 from opening, and thus it is possible to reliably keep the lever 100 not to be separated. For this reason, it is possible to improve reliability of the lever type connector.

Some of the protrusions 115 and 116 and the reception portions 15A and 15 normally engage with each other in the course of swinging the lever 100 from the position (position shown in FIG. 8 and FIG. 9) of mounting the lever 100 on the male connector housing 10H to the temporary locking position (FIG. 2 and FIG. 13). Accordingly, it is possible to prevent the lever 100 from being separated, and it is possible to improve workability of assembly.

The reception portions 15A and 15B are provided on both of the outside faces 11A and 11B on the front and back sides of the male connector housing 10H. Accordingly, it is possible to prevent both of the lever side plates 102 from opening with satisfactory balance, and thus it is possible to prevent the lever 100 from deviating.

Even when the temporary locking arm 110 is deformed by applying excessive force (arrow F1 or F2 shown in FIG. 3 and FIG. 8) to the lever 100 in the state where the lever 100 before connector fitting is positioned at the temporary locking position, the bending restricting protrusion 113 provided on the temporary locking arm 110 is engaged with the inner face side of the lever side plate 102, thereby restricting the bending of the temporary locking arm 110 in the temporary locking direction. Accordingly, it is possible to securely keep the engagement state of the temporary locking arm 110 and the temporary locking portion 18, and thus the temporary locking arm 110 does not easily deviate from the temporary locking protrusion. Therefore, it is possible to keep the temporary locking state of the lever 110, thereby improving reliability.

In this case, as a void to which the protrusion 113 goes at the time of deforming the temporary locking arm 110, the clearance groove 119 provided on the inner face of the lever side plate 102 is used. Accordingly, it is unnecessary to secure a new void separately. Therefore, it is possible to easily improve reliability just by adding the protrusion 113.

Next, an operation of fitting to the female connector 200 will be described.

The male connector 10 with lever 100 kept at the temporary locking position is first inserted to the fitting hole 201 of the female connector housing 200H. The lever 100 goes into the fitting hole 201 together with the male connector housing 10H. At that time, the rib 14 is guided by the guide groove 202, thereby confronting the male connector 10 with the female connector 200 in a correct posture and leading the cam protrusion 120 to an entrance of the cam groove 220.

At the beginning step of this insertion, as shown in FIG. 14, the temporary releasing protrusion 111 provided at the front end of the temporary locking arm 110 comes into contact with the temporary releasing portion 210, and the temporary locking arm 110 is bent outward by the operation of the slope of the temporary releasing portion 210, thereby getting out of the position of engaging with the temporary locking protrusion 18. When the male connector 10 is put into the female connector 200 while pressing the lever 100 toward the female connector 200, the temporary locking state of the temporary locking arm 110 and the temporary locking protrusion 18 is released. Accordingly, the state is in a state capable of putting in while swinging the lever 100. Both of the connectors 10 and 220 are completely fitted by the cam operation of the cam protrusion 120 and the cam groove 220 by swinging and putting the lever 100.

As described above, in the case of the lever type connector, since the lever 100 before connector fitting is kept at the temporary locking position, it is possible to smoothly perform the fitting operation of the female and male connectors 10 and 200 by the operation of the lever 100 from the temporary locking state in which the positions of the cam groove 220 and the cam protrusion 120 are previously matched.

In addition, in the state of fitting the female and male connectors 10 and 200 to each other, since the lever 100 is not exposed outward, the lever type connector can have a compact structure.

In the above description, the case of mounting the lever 100 in the first direction has been described, but the lever 100 may be mounted on the male connector housing 10H in the opposite direction. Also in that case, since the reception portions 15A and 15B close to the male connector housing 10H are disposed in bilateral symmetry, it is possible to prevent the lever 100 from being separated irrespective of the direction of attaching the lever 100 to the male connector housing 10H.

What is claimed is:

1. A lever type connector, in which a lever is swingably mounted on one connector housing of a pair of connector housings, the lever has a pair of lever side plates having a swing fulcrum portion on each end side, and an operation portion connecting the other ends of the pair of lever side plates to each other, the lever is mounted on one connector housing by fitting the swing fulcrum portion close to the lever to the swing fulcrum portion provided on an outer peripheral face of the one connector housing, the lever is swung in a connector fitting direction from a temporary locking position kept by engaging a flexible temporary locking arm protruding on the lever side plate with a temporary locking protrusion formed on the one connector housing, and fitting both of the connectors housings to each other by an operation of a cam mechanism provided between the lever and the other connector housing, wherein the temporary locking arm is provided with a bending restricting unit, and when predetermined external force is applied to the lever in a state where the lever is positioned at the temporary locking position before connector fitting, the bending restricting unit engages with the lever side plate by deformation of the temporary locking arm caused by the external force to restrict bending of the temporary locking arm in a temporary releasing direction.

2. The lever type connector according to claim 1, wherein the temporary locking arm is disposed in a cantilever shape close to an outer peripheral portion on the front side of the lever side plate in the connector fitting direction, with a spilt gap between the lever side plate and the temporary locking arm, and the locking to the temporary locking protrusion is released by bending the temporary locking arm outward, and wherein a protrusion is provided as the bending restricting unit, and when the temporary locking arm is deformed in a direction of making the spilt gap narrow by applying the predetermined external force, the protrusion is engaged with the inside of the adjacent lever side wall, thereby restricting bending of the temporary locking arm outward.

3. The lever type connector according to claim 1, wherein a clearance groove for avoiding interference of the lever side plate and the temporary locking protrusion at the time of swinging the lever is formed in the inner face of the lever side plate, and the bending restricting protrusion of the temporary locking arm is configured to go into the clearance groove.

* * * * *